US006508423B2

(12) United States Patent
Gloor

(10) Patent No.: US 6,508,423 B2
(45) Date of Patent: Jan. 21, 2003

(54) APPARATUS FOR THE TREATMENT OF SUBSTANCES

(75) Inventor: Alfred Gloor, Rupperswil (CH)

(73) Assignee: Rosenmund VTA AG, Liestal (CH)

( * ) Notice: Subject to any disclaimer, the term of this patent is extended or adjusted under 35 U.S.C. 154(b) by 0 days.

(21) Appl. No.: 09/765,635

(22) Filed: Jan. 22, 2001

(65) Prior Publication Data

US 2001/0020657 A1 Sep. 13, 2001

(30) Foreign Application Priority Data

Jan. 21, 2000 (CH) ..... 0121/00

(51) Int. Cl.[7] ..... B02C 19/00

(52) U.S. Cl. ..... 241/57; 366/102; 366/341; 241/65; 241/101.8; 241/199.12; 241/285.2

(58) Field of Search ..... 366/297, 298, 366/299, 300, 102, 103, 104, 149, 341; 241/101.8, 285.2, 285.3, 199.12, 65, 57

(56) References Cited

U.S. PATENT DOCUMENTS 4,674,692 A 6/1987 Killer et al.

4,983,046 A * 1/1991 Murata et al. ..... 241/199.12

FOREIGN PATENT DOCUMENTS

EP 203 598 5/1986

* cited by examiner

*Primary Examiner*—Mark Rosenbaum
(74) *Attorney, Agent, or Firm*—Jacobson Holman PLLC

(57) ABSTRACT

The apparatus comprises a container which essentially has the shape of a body of revolution and comprises two half-shells detachable from one another and having a vertical axis. The container preferably has the shape of a sphere with a material inlet arranged in the upper half-shell and a material outlet arranged in the bottom of the lower half-shell. Also arranged in the container is a stirrer which is rotatable about an axis inclined not more than 20° and which is connected to a drive device arranged on the upper half-shell and picks up and constantly circulates the entire material during operation of the apparatus. The apparatus is suitable as a dryer, mixer and, with introduction of a suitable liquid, also as a granulator and can be used not only for chemical synthesis but also as a reactor, for example in the pharmaceutical manufacturing stage, in combined applications. Particular advantages of the apparatus according to the invention are the pressure surge resistance and the simple maintenance and cleaning by separation of the lower half-shell from the fixed upper half-shell.

10 Claims, 2 Drawing Sheets

APPARATUS FOR THE TREATMENT OF SUBSTANCES

BACKGROUND OF THE INVENTION

1. Field of the Invention

The present invention relates to an apparatus for the treatment of substances, comprising a rotationally symmetrical container and a tool shaft which is mounted concentrically relative to a container axis and has at least one stirring member.

The apparatus can be used, for example, for drying of pharmaceutical active substances, natural remedies and fine chemical products and products of the food industry. It is possible to dry relatively large batches in a relatively short time in a container. The drying process can be carried out, alternatively and dependent on the substance to be treated, under atmospheric pressure or in vacuo. For example, an apparatus can readily be designed for drying batches of the magnitude of 1000 kg, it being possible, depending on the characteristics of the substances, to dry such a batch in a relatively short time, which is only a few hours or even less than one hour.

However, the apparatus can also be used for the preparation of powder blends, granules and the like, for example food and pulverulent drugs.

2. Description of the Prior Art

In the preparation of many substances of industrial and private use, which are also referred to below as materials, it is frequently necessary to mix different types of ingredients with one another. In various cases, it is also required to bring about a chemical reaction in the mixture. The uniform distribution of the individual ingredients of the mixture is sometimes resisted to a considerable extent by individual components. In such mixing processes and particularly in drying processes, relatively high pressures result. In order to be able to absorb such pressures, apparatuses for drying a material which have a spherical container have already been developed. A particular advantage of this apparatus also referred to as a ball dryer, is that they have a pressure shock resistance which is higher than that of apparatuses having a container, for example a cylindrical one.

Known ball dryers are intended for batchwise operation and have a spherical container with a wall containing a heating and cooling device, a stirrer introduced from below into the interior of the container and at least one feed device arranged on the upper part of the container and connected via an inlet to the interior of the container. Optionally, a homogenizer, also referred to below as a shredder, can additionally be rotatably mounted in the container.

If, for example, a dry material intended as a food is prepared using the known apparatuses, said material is introduced into the interior of the container via the feed device. The material is then agitated and mixed by means of a stirrer, optionally further components and additives, such as, for example, liquids, colorants and the like, also being added to the material during the mixing and/or drying process.

In the case of a ball dryer standing on a frame in the production room or clean room of an industrial facility, the material outlet and also the drive device of the stirrer are arranged on the lower part of the container. This has important disadvantages with regard to compliance with hygiene regulations in the production of, for example, drugs and food. In such cases, it is in fact necessary for those machine parts of the stirrer which are arranged outside the container, i.e. said drive devices, to be spatially separated from the material outlet by a housing enclosing said drive device, i.e. by additional constructional measures.

Moreover, such an apparatus is difficult to clean and maintain. Thus, both for removing the feed means and in particular the stirrer and also for cleaning the interior, the upper part of the container has to be removed with relatively great effort, whereupon the stirrer is removed from the spherical container from above. Furthermore, this manipulation complicates the cleaning of the entire apparatus and the subsequent assembly, particularly when the cleanliness of the internal container part has to meet high requirements.

SUMMARY OF THE INVENTION

It is the object of the invention, starting from a ball dryer, to provide an apparatus for the treatment of substances which does not have the above-mentioned disadvantages. It is intended in particular to retain a rotationally symmetrical, for example spherical, container shape and to provide a construction which makes it possible to dispense with constructional measures for shielding parts of the apparatus and which permits simple removal of the stirrer and the like.

This object is achieved according to the invention by an apparatus comprising a rotationally symmetrical container, a material inlet opening into the interior of the container and a material outlet leading out of said interior, a stirring unit having a shaft and at least one stirring member. The apparatus is further characterized in that the container has an upper and a lower half-shell each having a vertical axis of rotation, that the material inlet is arranged in the upper half-shell and the material outlet is arranged in the lower half-shell, that the lower half-shell can be separated from the remaining part of the container and that the shaft of the stirring unit is rotatably about a vertical axis or an axis which is inclined not more than 30° and is connected to a drive device arranged on the upper half-shell.

The container of the apparatus according to the invention consists of two half-shells and has essentially the shape of a body of revolution with a horizontal and a vertical plane of symmetry, i.e. is rotationally symmetrical with respect to a horizontal and a vertical axis of rotation. The container preferably has the shape of a sphere with a material outlet arranged in the bottom of the lower half-shell. A stirrer which is rotatable about a vertical axis or via an axis inclined at most 30°, preferably 15° to 20°, and which is connected to a drive device arranged on the upper half-shell and, during operation of the apparatus, picks up the entire material and constantly circulates it is arranged in the container. The apparatus is suitable as a dryer, a mixer and, with introduction of a suitable liquid, also as a granulator and can be used not only for chemical synthesis but also in combined applications in the pharmaceutical manufacturing stage. Particular advantages of the apparatus according to the invention are the pressure surge resistance and the simple maintenance, cleaning and monitoring of the cleaned components.

BRIEF DESCRIPTION OF THE DRAWING

The subject of the invention is described with reference to two embodiments shown in the drawing. Here.

DESCRIPTION OF THE PREFERRED EMBODIMENTS

Figure 1:
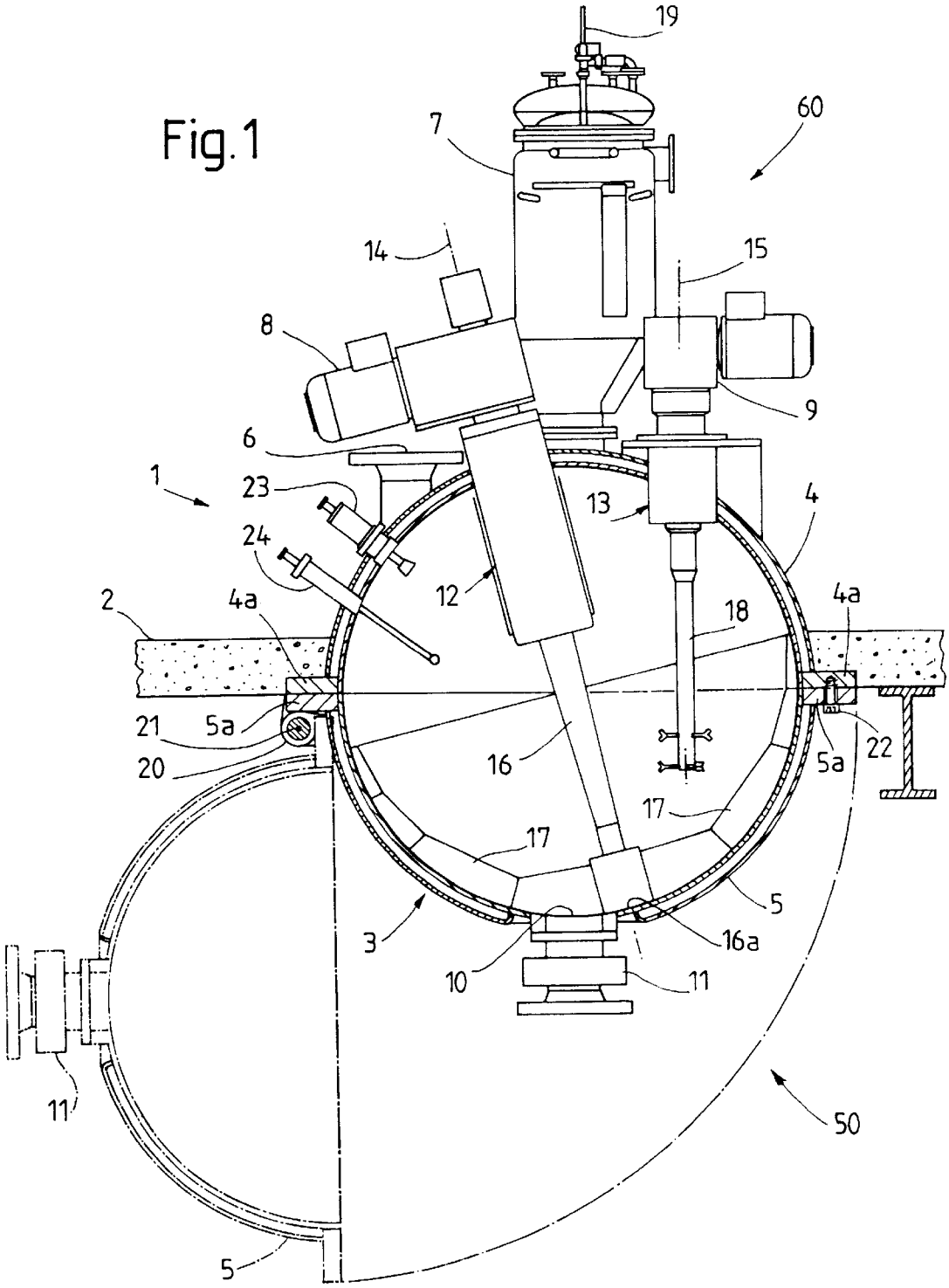
FIG. 1 shows a schematic vertical section through an apparatus for drying a material, comprising a spherical container formed from two half-shells.

The apparatus shown in FIG. 1 and denoted as a whole by 1 has a spherical container 3 which is held immovably in the ceiling 2 of a production room or clean room 50 and comprises an upper and a lower half-shell 4 and 5 having a vertical axis. The upper half-shell 4 is—as indicated in the drawing—provided with the material inlet 6 and a drying and filtration unit 7 and carries two drive devices 8 and 9 described in more detail below. The lower half-shell 5 has, in its bottom, the material outlet 10 which can be shut off with an outlet member 11. The outlet member 11 is, for example, in the form of a slide valve, flap valve or ball valve.

The two half-shells 4 and 5 of the container 3 comprise essentially—i.e. apart from any window present and from seals and the like—at least one metallic material, for example stainless steel. The two half-shells 4 and 5 are preferably double-walled and may additionally be provided with a heating and/or cooling device which is not shown, for example a heating and/or cooling coil, in particular in the manner known for dryers, mixers and the like. The wall and/or the heating and/or the cooling device may finally also be provided with heat insulation if required by the intended modes of operation.

The drive devices 8 and 9 arranged on the upper half-shell 4 belong to a stirring unit 12 or to a shredder 13. They each have a housing in which a shaft is mounted so as to be rotatable about an axis 14 or 15. The stirring unit 12 furthermore possesses a stirrer 16 which is connected by a rigid connection or friction clutch to the shaft of the drive device 8 so that it can be rotated by means of this. The stirrer 16 has, for example, three stirring members 17 which are arranged symmetrically with respect to one another, have a shape adapted to the inner surface of the lower half-shell 5 and are coolable and/or heatable by means of at least one integrated heating and/or cooling coil. Depending on the mode of operation and on the material to be treated, the stirring unit 12 can of course also have another stirrer, for example a helical stirrer.

Furthermore, the stirring unit 12 may also be equipped with a gas feed for drying and/or final drying of the material, in particular as disclosed, for example, in EP-A 0 203 598. In order to accelerate the drying, the stirrer 16 is usually heated. In this case, any existing gas feed lines of the stirring member are preferably arranged so that the gas is heated up on flowing through and thus emerges as heated gas during operation of the apparatus, with the result that the drying process is further optimized.

The stirring axis 14 is inclined by 15°, in particular in such a way that the foot 16*a* of the stirrer 16 does not cover the outlet 10 aligned coaxially with the vertical axis of the half-shell 5. The dried material can thus be removed without difficulties through the outlet 10 and the stirrer can even continue rotating about the axis 14 during the removal of the material, so that the product can run out uniformly and completely.

The shredder 13 has a homogenizing rod 18 which is rotatable about the vertical axis 15 and has the shape of known homogenizers or knife shafts.

The material inlet 6 is provided with feed means, which are not shown, for feeding a material, for example a pulverulent one, which is stored in a store likewise not shown—for example a continuous loadable store.

The filtration unit 7 is provided with at least one filter. During operation of a continuous process, gas, preferably $N_2$, can be fed into the container for cleaning the filter bags. The associated gas-conducting and gas-transporting means have a gas feed line which is denoted by 19.

The two half-shells 4 and 5 are detachable from one another and, as indicated in FIG. 1, are provided with outward-projecting flanges 4*a* and 5*a* which are connected to one another via a joint 20. The latter has a horizontal axis 21 of rotation and is arranged on the underside of the ceiling 2, which incidentally may also be an intermediate ceiling. The two flanges 4*a* and 5*a* are additionally provided with screws 22 or other detachable connecting means, for example bayonet joints, in order to close the container 3 for operation of the apparatus 1.

As is evident from the drawing, the upper half-shell 4 is held immovably in the ceiling 2 of the production room or clean room 50, in particular in such a way that, with the exception of the section inserted into the ceiling 2, it projects completely into the machine space 60 located above the production room 50, and that the lower half-shell 5 connected to it via the joint 20 can be swivelled downwards away from the ceiling 2.

The apparatus 1 may have further components not defined in detail, such as a further filling port 23, in order to subject the material prior to drying in the container 3 to another treatment, in order, for example, to agglomerate the particles originally present to give larger particles or to provide the particles originally present with a coating. For this purpose, additional means may be present for introducing a liquid into the container and/or for spraying a material onto the particles.

Furthermore, the container wall and the filtration device may additionally be provided with a cleaning system which has a plurality of optionally retractable spray nozzles 24, so that the interior of the container, the stirrer 16 and the homogenizer rod 18 can be cleaned in the closed state, i.e. without opening the apparatus.

Moreover, an electronic device, which is not shown, may also be present for controlling and possibly regulating the operation of the apparatus 1 in the form of a dryer. The control or regulation can be effected manually by operating switches and/or at least partly automatically. The automatic control can be effected according to a program with predetermined time sequence and/or on the basis of measurements.

As already mentioned in the introduction, the simple maintenance, cleaning and monitoring of the cleaned apparatus are particular advantages of the invention. Thus, by swivelling down the half-shell 5, the interior of the container can be exposed so that the stirrer 16 and homogenizing rod 18 can be removed from the container 3 from below without complicated dismantling work and relatively easily. Furthermore, by installing the container 3 in the ceiling 20 of the clean room 50, the drive devices 8 and 9 of the stirring unit 12 and of the shredder 13 and also the apparatus parts of the drying unit 7 can be relatively easily separated from the clean room 50, so that no additional constructional measures are required for spatially separating the machine parts of the stirrer 12 and shredder 13 from the material outlet 10. A further advantage of the invention is that, owing to the novel design, the seals of stirring unit 12 and shredder 13 are not immersed in the product during the operation of the apparatus 1, as is the case in known ball dryers.

The apparatus described with reference to FIG. 1 constitutes only one choice from a plurality of possible embodiments of the invention and can be modified in various respects.

Figure 2:
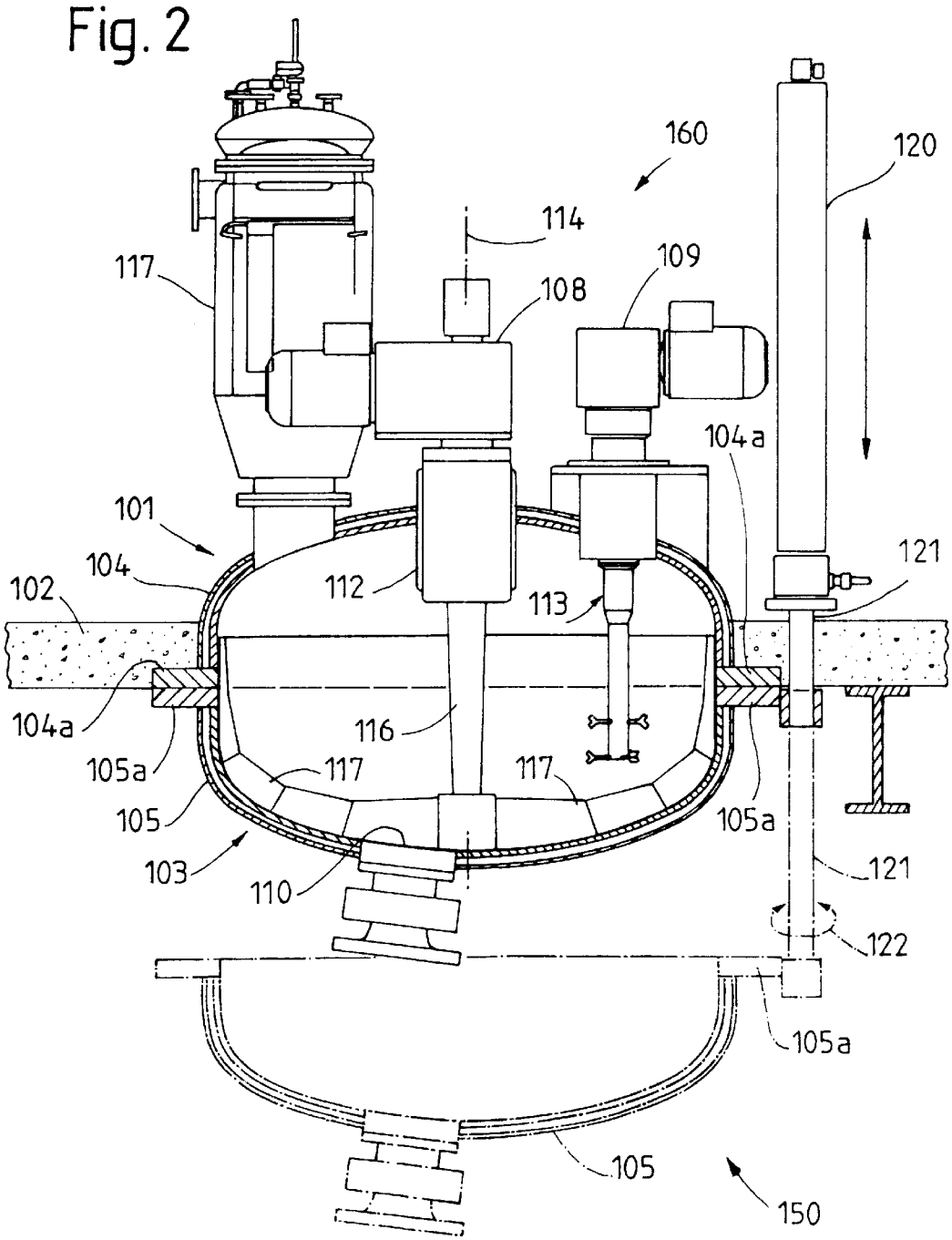
FIG. 2 shows a schematic vertical section through a second apparatus comprising a container likewise formed from two half-shells.

Another embodiment of the invention is therefore shown in FIG. 2. The apparatus denoted as a whole by 101 in this Figure is formed substantially similarly to the apparatus 1 described with reference to FIG. 1, i.e. has a container 103 which is held firmly in the ceiling 102 of the production room or clean room 150 and comprises an upper and a lower, half-shell 104 and 105 having a vertical axis. The upper half-shell 104, too, carries the drying and filtration unit 107 and the two drive devices 108 and 109 of the stirring unit 112 and shredder 113.

In contrast to the apparatus 1, the apparatus 101 has a somewhat modified container shape 103. Thus, although it does not have the shape of a sphere, it is essentially a body of revolution having a horizontal and a vertical plane of symmetry and a horizontal and a vertical axis of rotation.

As is furthermore evident from FIG. 2, the shaft 114 of the stirring unit 112 coincides with the vertical axis of the container 103. As a consequence of this, the outlet 110 is arranged not centrally in the vertical axis of the container 103 but offset therefrom, and the blade arms 117 of the stirrer 117 have a shape which is modified compared with the blade arms 17 and adapted to the inner surface of the lower half-shell 105.

The two half-shells 104 and 105 of the container 103 are also detachable from one another and, as indicated in FIG. 1, provided with outward-projecting flanges 104*a* and 105*a* which are connected to one another by means of screws or other detachable connecting means which are not shown.

As is furthermore evident from FIG. 2, the upper half-shell 104 is held immovably in the ceiling 102, in particular in such a way that it projects virtually completely into the machine space 160 located above the production room 150, and that that surface of the flange 104*a* which is intended for abutting the flange 105*a* is flush with the ceiling surface. The lower half-shell 105 in turn is arranged on the support arm 121 of a lifting and lowering device 120, for example a hydraulically or pneumatically controllable one, in such a way that it can be separated from the upper half-shell 104 and moved vertically downwards for maintenance and cleaning purposes. In order to facilitate access to the stirrer 116 and shredder 113 from below, the lifting and lowering device 120 may additionally be provided with a rotation mechanism in order subsequently to swivel the lowered half-shell 105 into the direction of rotation 122.

The dimensions of the apparatus according to the invention may vary within wide limits, it being possible for the effective volume of the container to be, for example, of the order of from 20 to 6000 l. Depending on the effective volume of the container, it is of course also possible for the dimensions and shapes of the essentially rotationally symmetrical containers to vary. Thus, the container can of course also have the shape of an ellipsoid of revolution or may furthermore have a cylindrical wall section between the two half-shells, with the result that the effective volume of the container is increased.

What is claimed is:

1. Apparatus for treating a material, comprising a rotationally symmetrical container, a material inlet opening into the interior of the container and a material outlet leading out of said interior, a stirring unit having a shaft and at least one stirring member, wherein the container has an upper and a lower half-shell each having a vertical axis of rotation, wherein the material inlet is arranged in the upper half-shell and the material outlet is arranged in the lower half-shell, wherein the lower half-shell can be separated from the upper half-shell of the container and wherein the shaft of the stirring unit is rotatable about a vertical axis or an axis which is inclined not more than 30° and is connected to a drive device arranged on the upper half-shell.

2. Apparatus according to claim 1, wherein said container includes a shredder including a shaft rotatable about a vertical axis and connected to a drive device arranged on the upper half-shell.

3. Apparatus according to claim 1, wherein the upper half-shell is installable in the ceiling of a production room.

4. Apparatus according to claim 1, wherein said upper and lower half-shells are connected to one another via a joint in such a way that the lower half-shell can be swivelled downward about a horizontal axis.

5. Apparatus according to claim 1, wherein the lower half-shell is fastened to a support arm of a lifting and lowering device in such a way that said lower half-shell can be separated from the upper half-shell and moved vertically downwards and then swivelled horizontally.

6. Apparatus according to claim 1, wherein the container is spherical.

7. Apparatus according to claim 6, wherein the material outlet is arranged in the bottom of the lower half-shell and wherein the shaft of the stirring unit is rotatable about an axis which is inclined not more than 20° relative to the vertical axis of the container.

8. Apparatus according to claim 1, wherein the stirring unit is coolable and/or heatable.

9. Apparatus according to claim 1, wherein the stirring unit is equipped with a gas feed.

10. Apparatus according to claim 9, wherein gas fed by the gas feed can be preheated by stirrer heating before the gas enters the interior of the container.

* * * * *